United States Patent [19]

Doughty

[11] Patent Number: 4,572,536

[45] Date of Patent: Feb. 25, 1986

[54] I V POLE INTERCONNECTION COUPLING

[76] Inventor: Val J. Doughty, 512 E. Riviera Dr., Tempe, Ariz. 85282

[21] Appl. No.: 498,324

[22] Filed: May 26, 1983

[51] Int. Cl.[4] ..... A47C 7/62

[52] U.S. Cl. ..... 280/289 WC; 297/188; 297/DIG. 4

[58] Field of Search ..... 280/289 WC, 289 R, 289 A, 280/292, 204; 297/188, 192, 194, 186, DIG. 4; 5/60, 503, 508; D24/52

[56] References Cited

U.S. PATENT DOCUMENTS

| | | | |
|---|---|---|---|
| 2,375,696 | 5/1945 | Shick | 297/188 X |
| 2,470,524 | 5/1949 | Scudder | 5/503 X |
| 2,696,963 | 12/1954 | Shepherd | 5/503 X |
| 2,957,187 | 10/1960 | Raia | 5/503 |
| 3,709,372 | 1/1973 | Alexander | 5/503 X |
| 3,709,556 | 1/1973 | Allard | 297/188 |
| 4,174,120 | 11/1979 | Freeman | 280/204 |
| 4,305,601 | 12/1981 | Berge | 280/289 WC |
| 4,332,378 | 6/1982 | Pryor | 211/205 X |
| 4,511,157 | 4/1985 | Wilts | 280/289 WC |
| 4,511,158 | 4/1985 | Varga et al. | 280/292 |

*Primary Examiner*—John A. Pekar
*Attorney, Agent, or Firm*—LaValle D. Ptak

[57] ABSTRACT

A coupling is provided for interconnecting a wheeled intravenous feeding bottle support stand with a wheelchair or wheeled bed in a hospital so that a single attendant can move the wheelchair/stand combination together down the hall when necessary. The coupling includes a first hollow tubular member attached to the wheelchair or bed. This member receives a rotatably mounted second tubular member having an extension mounted on one end with a clamp for removable attachment to the pole of the wheeled intravenous feeding bottle support stand. The second tubular member and the clamp are rotated to a stored position adjacent the bed or behind the wheel chair when not in use. When use is desired, the second tubular member and the clamp are rotated to a use position which extends the clamp away from the bed or wheelchair a sufficient amount to permit the attachment to the pole of the intravenous feeding bottle support stand. A slot and pin arrangement is employed on the two tubular members to define the limits of rotation and relative axial movement of the two tubular members to one another.

9 Claims, 10 Drawing Figures

I V POLE INTERCONNECTION COUPLING

BACKGROUND OF THE INVENTION

In hospitals, nursing homes, and other health care facilities, it frequently is necessary to move a patient in a wheelchair or on a wheeled stretcher or bed from the patient's room to some other location in the hospital. Often such patients are being provided with intravenous feeding so that it is necessary to move the intravenous feeding bottle with the patient to the new location. For use in hospital rooms and the like, the intravenous feeding bottles typically are hung on a vertical pole mounted on a wheeled base. This permits ready movement of the pole to various locations adjacent the patient's bed to facilitate the work of the doctors, nurses, and other personnel entrusted with the care of the patient. Frequently, these intravenous feeding bottle support poles also have mounted on them a computerized self-contained metering device for accurately metering the rate of flow of fluid from the intravenous feeding bottle to the patient. These metering devices are quite expensive and subject to damage if they are dropped or the pole is tipped over.

Usually, two attendants are required to move a patient from the patient's room to the X-ray department or some other area of the hospital when the patient is on intravenous feeding. One of the attendants pushes the wheelchair or the wheeled stretcher or bed, and the other attendant steadies the wheeled intravenous feeding support stand and pushes it alongside the wheelchair or stretcher. Obviously, this is a waste of valuable personnel.

The alternative to using two attendants to push the wheelchair or bed from one location to another has been to attach the intravenous feeding stand pole directly to the wheelchair or bed. This, however, requires removal of the pole from its wheeled base to attach it to the wheelchair or bed. Alternatively, a separate pole is attached to the wheelchair or bed and the intravenous feeding bottle is moved from the wheeled stand to the pole attached to the patient-carrying wheeled device (wheelchair, stretcher, or the like). This latter transfer of the intravenous feeding bottle from one stand to another is relatively easy to accomplish for feeding bottles having a simple clamp-type droplet control device on the tube between the bottle and the patient. When, however, an electronic metering device of the type described above is employed, it is also necessary to transfer this device from one pole to another. This requires extra time and furthermore, presents the potential for dropping the metering device and damaging it in the transfer.

Separate I V pole attachments have been made for wheelchairs and wheeled beds or stretchers in the past. A typical device for a wheelchair is disclosed in U.S. Pat. No. 3,709,556 to Allard et al. This patent discloses a collapsible tubular I V pole which has attachments connected to it for supporting it on the horizontal and vertical frame members of a wheelchair. Intravenous feeding stands or poles for attachment to a bed or wheeled stretcher are disclosed in the patents to Shepherd, U.S. Pat. No. 2,696,963, Scudder, U.S. Pat. No. 2,470,524, Alexander, U.S. Pat. No. 3,709,372, and Raia, U.S. Pat. No. 2,957,187. All of these patents disclose I V bottle support poles or stands which are attached to the frame of a bed or stretcher. The attachments are semipermanent in nature, since the poles are not mounted on a separate wheeled stand.

The patent to Berge, U.S. Pat. No. 4,305,601, is of interest to the overall subject matter since it discloses a means for interconnecting a grocery shopping cart and a wheelchair for movement together. This is accomplished with a hitch assembly which is releasably attached to the wheelchair and rigidly attached to the shopping cart. A foldable drawbar is used to interconnect the shopping cart and wheelchair for movement together through the store.

While it is not directed to a wheelchair or stretcher application in any way, a patent to Freeman, U.S. Pat. No. 4,174,120 illustrates a rigid bar connector for interconnecting a bicycle and a wheeled cart together to permit the cart to be towed by the bicycle. When not in use, the tow bar folds to a generally out-of-the-way position on the bicycle.

It is desirable to provide a rugged, simple to use, and relatively inexpensive device for interconnecting a wheelchair or wheeled stretcher or the like to a wheeled I V pole to permit a single attendant to move a patient in a wheelchair or on a stretcher from one point to another in a hospital without interrupting the I V fluid connection to the patient. It further is desirable to move the standard I V pole mounted on a wheeled base along with a wheelchair or wheeled stretcher with a rigid and sure interconnection between the wheelchair and wheeled I V pole stand.

SUMMARY OF THE INVENTION

Accordingly, it is an object of this invention to provide an improved coupling member.

It is an additional object of this invention to provide an improved coupling member for interconnecting a wheelchair or the like and a wheeled I V stand pole.

It is another object of this invention to provide an improved, relatively rigid coupling between a wheelchair or other wheeled patient-carrying apparatus and a wheeled I V stand pole for movement from one point to another using a single attendant.

It is a further object of this invention to provide an improved easily-attachable and detachable rigid coupling for interconnecting a wheelchair or other wheeled patient-carrying apparatus to a wheeled I V stand pole for movement from one point to another in a hospital or the like by a single attendant.

In accordance with a preferred embodiment of this invention, a coupling for interconnecting a wheeled intravenous feeding (I V) bottle support stand or pole with a wheeled patient-carrying apparatus, such as a wheelchair or stretcher, includes first and second tubular members. The first tubular member is adapted to be rigidly attached to the patient-carrying apparatus. The second tubular member has a clamp attached to one end of it for removable attachment to the pole of a wheeled intravenous feeding bottle support stand. The other end of the second tubular member is rotatably interconnected with the first tubular member to permit relative axial rotation between the two members. The second member is rotated to a first stored position relative to the first member when it is not in use and is rotated to a second use position for connection of the clamp to the I V support stand pole to couple the stand for movement with the wheeled patient-carrying apparatus.

DETAILED DESCRIPTION

Figure 1:
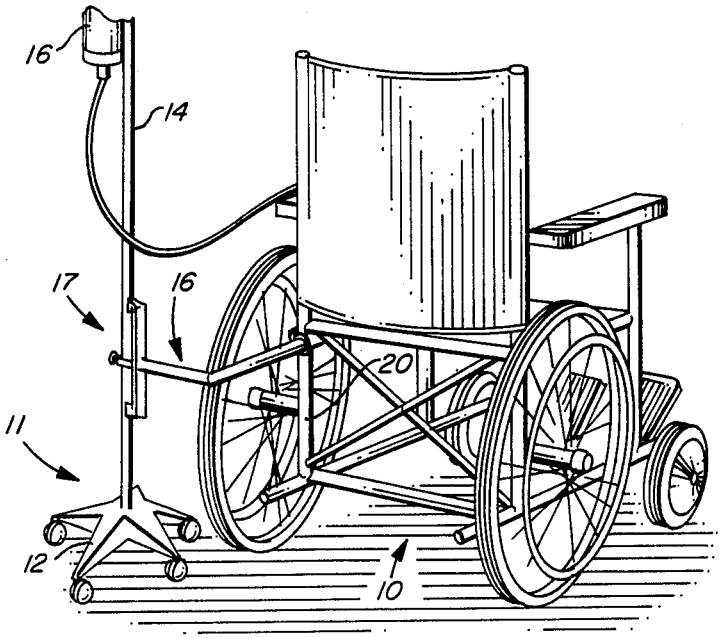
FIG. 1 is a perspective view illustrating the manner in which a preferred embodiment of the invention is used to interconnect a wheelchair and a wheeled I V stand pole.

Reference now should be made to the drawings in which the same reference numbers are used throughout the different figures to designate the same or similar components. FIG. 1 illustrates a wheelchair 10 coupled with a preferred embodiment of the invention to a wheeled intravenous (I V) support stand 11. The I V support stand 11 includes a wheeled base 12 and a vertical pole 14 which has an intravenous feeding bottle 16 hung on it in a conventional manner. The wheeled I V stand 11 and the wheelchair 10 are rigidly connected together for movement from one place to another by means of an L-shaped coupling 16 carrying a detachable clamp 17 on one end, and the other end of which is attached to the frame of the wheelchair 10.

Figure 2A:
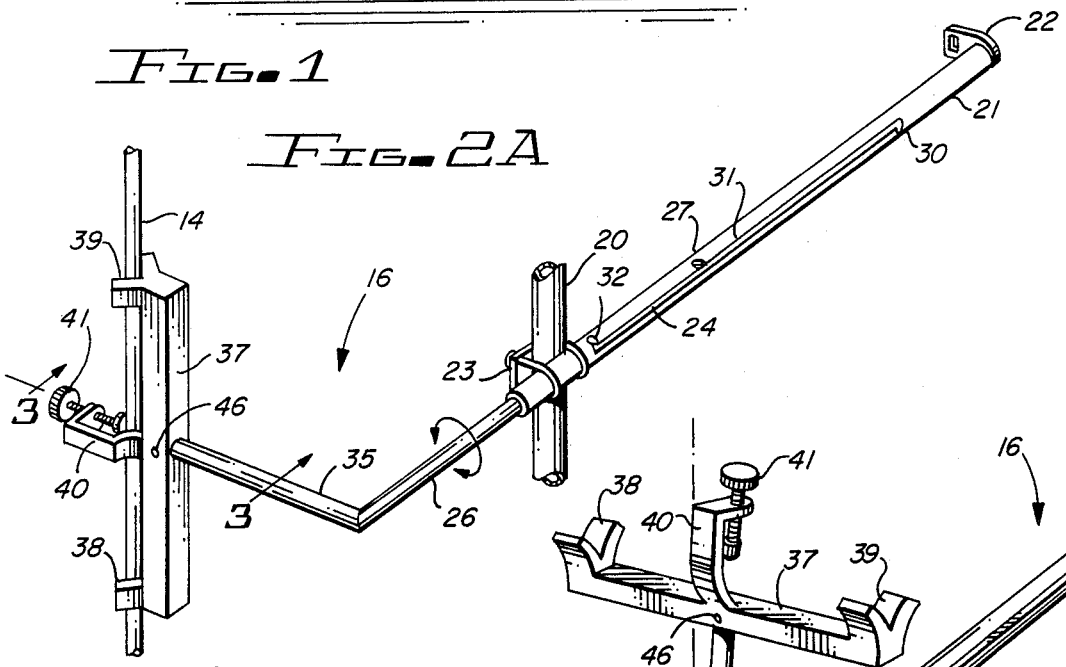
FIGS. 2A and 2B illustrate details of a preferred embodiment of the invention.
Figure 2B:
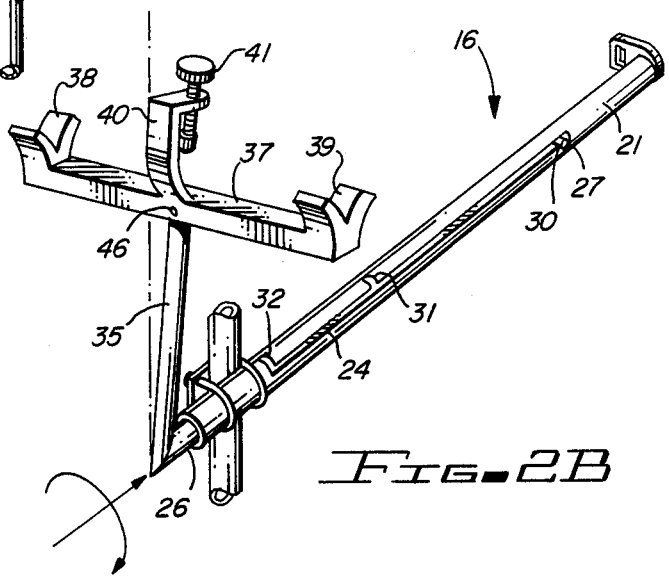

FIGS. 2A and 2B show the details of the coupling 16 and reference should be made to these figures, in conjunction wth FIG. 1, for an understanding of various portions of the coupling 16 and the manner in which it is used. The coupling 16 includes a first hollow tube 21 which is attached (by means not shown) at its forward end by a flange 22 to a forward vertical upright member on the wheelchair 10. At its other end, the tube 21 is clamped to a rear vertical upright wheelchair strut 20 by means of a conventional clamp 23. The vertical height of the tube 21 from the ground may be adjusted by the selection of the points at which the flange 22 and clamp 23 are connected to the wheelchair. Once the tube 21 is attached to the wheelchair 10, it usually is left in place, although it may be removed from the wheelchair and placed on another one whenever desired.

Figure 5:
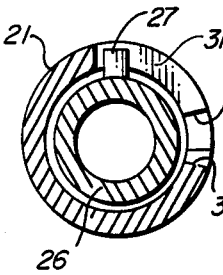
FIG. 5 is a cross-sectional view taken along the Lines 5—5 in FIG. 4.
Figure 4:
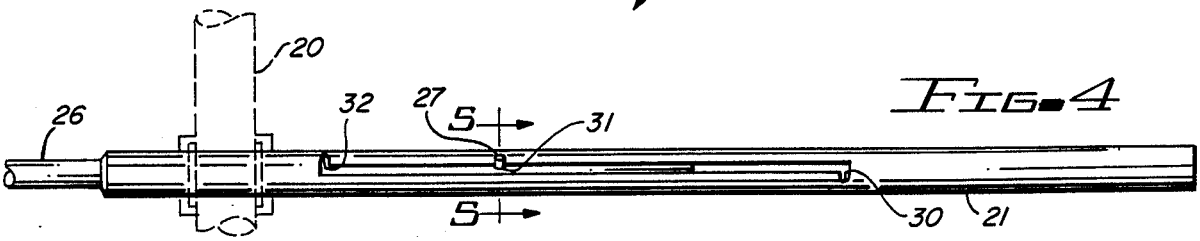
FIG. 4 illustrates details of a portion of the embodiment shown in FIGS. 2A and 2B.

As illustrated in FIGS. 2, 4, and 5, the tube 21 is hollow and has a circular cross-section. This is shown most clearly in FIG. 5. An elongated slot 24 is cut through the wall of the tube 21 intermediate its ends for a major portion of its length parallel to the axis of the tube 21. When the tube 21 is installed on a wheelchair, this slot is in a plane which is substantially parallel to the floor surface on which the wheelchair is used.

The coupling between the wheelchair and the I V pole 14 of the wheeled stand 11 is effected by means of an L-shaped telescoping extension comprising a tubular member or rod 26 which slidably fits into the open end of the tube 21 for axial movement into and out of the tube 21. After the rod 26 is inserted into the tube 21, a pin 27 is attached to it (shown most clearly in FIG. 5) and is dimensioned to fit in the slot 24 and to slide back and forth in that slot.

Three circumferential slots 30, 31, and 32 open from the axial slot 24 in the tube 21 and extend part way circumferentially from the slot 24 around the tube 21. The slot 30 extends a slight distance downwardly (as the apparatus is shown installed on a wheelchair in FIGS. 1, 2, 4, and 5) while the slots 31 and 32 extend approximately 90° circumferentially upwardly around over the top of the tube 21 in the installed position. This is shown most clearly in FIGS. 2 and 4. When the device is in its stored position, the rod 26 is rotated clockwise as viewed from the left end in FIG. 2 to the position shown in FIG. 2B. Then the rod 26 is pushed inwardly (toward the front of the wheelchair 10) until the pin 27 hits the end of the slot 24 and is rotated clockwise to cause the pin 27 to be seated in the slot 30 as shown in FIG. 2B. This causes the extension 35, attached at an angle of 90° to the end of the rod 26, to occupy the position shown in FIG. 2B, and the weight of clamp bracket 37 carried on the other end of the extension 35 causes the parts to maintain the relative positions shown in FIG. 2B (with the extension 35 tipped to the right of vertical) during normal use of the wheelchair.

When the apparatus is to be used to attach the pole of a wheeled I V stand 11 to the wheelchair 10, the rod 26 is rotated counterclockwise (as viewed from the left) until the pin 27 engages the upper edge of the slot 24. The rod 26 then is pulled out of the tube 21 until the pin 27 is aligned with either of the slots 31 or 32. The particular distance the rod 26 is pulled out depends on the clearance needed for the wheeled base 12 of the wheeled I V support stand to be attached to the wheelchair 10. As illustrated in FIGS. 2A, 4, and 5, the rod 26 is shown pulled to its intermediate position, with the pin 27 aligned with the slot 31 which is located on the upper side near the midpoint of the elongated axial slot 24. When the pin 37 is aligned with the slot 31, the rod 26 is rotated counterclockwise to cause the pin 27 to seat in the slot 31 and rest against the end of the slot 31. This places the parts of the apparatus in the relative positions shown in FIGS. 2A, 4, and 5.

In this position, the clamp bracket 37 is in a generally vertical orientation and it is positioned to cause the pole 14 of the I V stand 11 to rest between a pair of spaced-apart V-shaped supports 38 and 39. Intermediate the supports 38 and 39 is a threaded clamp member 40 having a thumbscrew 41 which is turned to press on the pole 14 on the side opposite the V-shaped supports 38 and 39 to cause the clamp bracket 37 to firmly but releasably engage the pole 14. In this position, the wheelchair 10 and wheeled I V stand 11 may be moved together from one location to another by a single attendant pushing the wheelchair 10.

Figure 3:
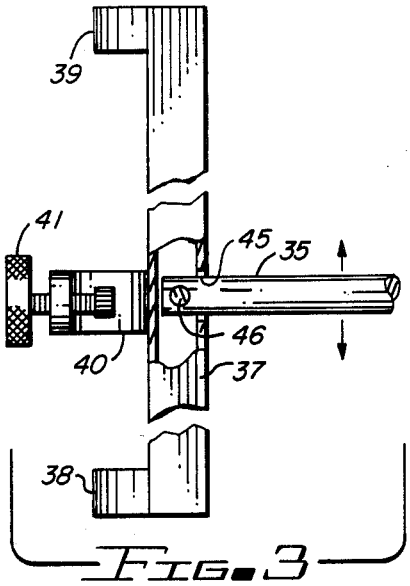
FIG. 3 is a detailed, partially broken-away illustration of a portion of the embodiment shown in FIG. 2A taken along the Line 3—3.

To accomodate for some unevenness in the floor or a slight variation from vertical between the support 20 on the wheelchair and the pole 14, the connection of the extension 35 to the clamp bracket 37 is made to permit a slight amount of relative rotational movement between the two parts. This is shown most clearly in FIG. 3. A circular hole 45 having a diameter which is slightly greater than the external diameter of the extension 35 is formed through the hollow body of the clamp bracket 37. A pin 46 then extends through the opposite sides of the clamp bracket 37 where it is attached to the body. The extension 35 is free for limited rotation about the pin 46 as determined by the width of the opening 45. This permits some relative limited rocking movement between the extension 35 and the clamp bracket 37, as indicated by the arrows in FIG. 3.

Figure 6:
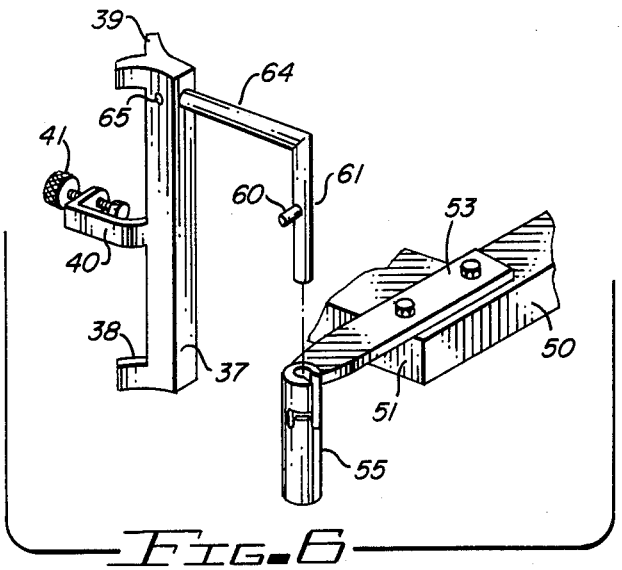
FIG. 6 is a perspective view of another embodiment of the invention.
Figure 7:
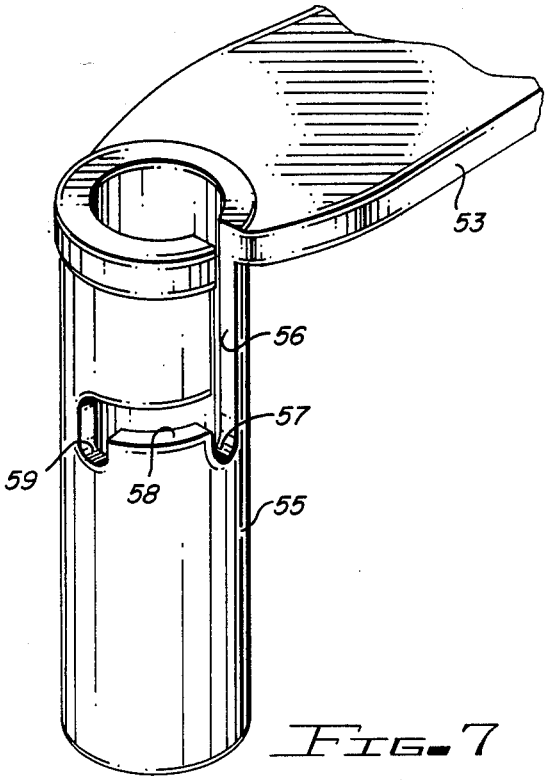
FIG. 7 illustrates details of a portion of the embodiment shown in FIG. 6.
Figure 8:
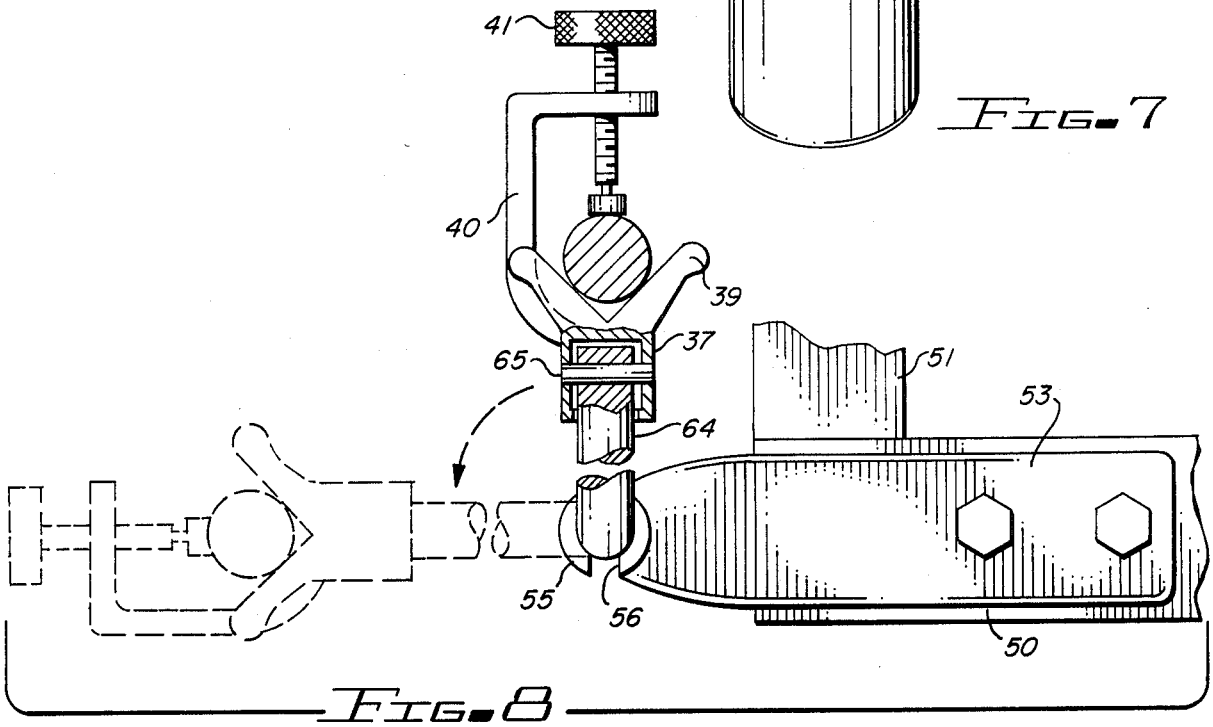
FIG. 8 is a top view of the embodiment shown in FIG. 6.
Figure 9:
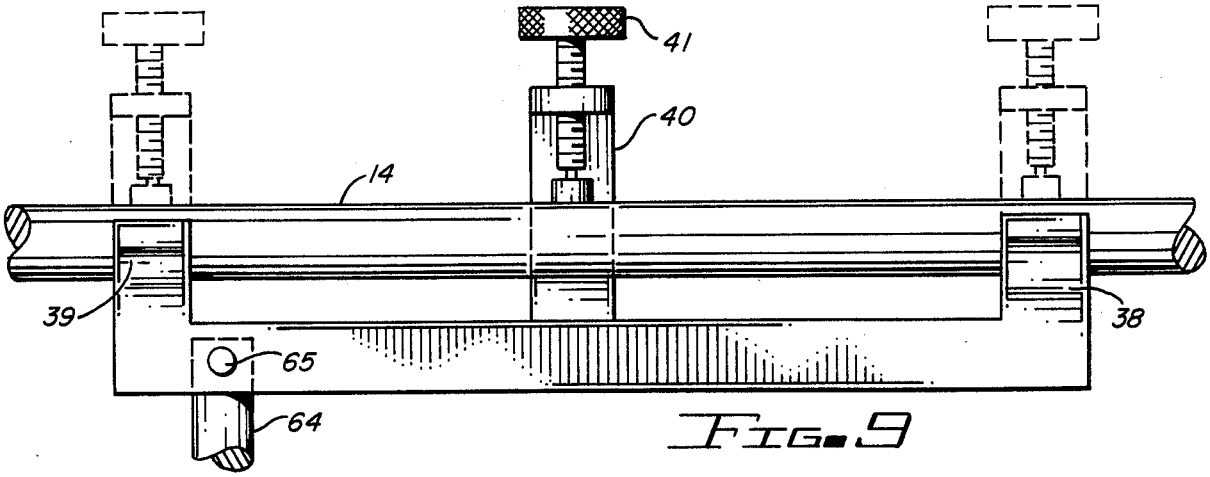
FIG. 9 is a side view of a portion of the embodiment shown in FIG. 6.

Reference now should be made to FIGS. 7 to 9 which illustrate another embodiment of the invention adapted for mounting on a wheeled bed or stretcher, instead of the wheelchair shown in FIG. 1. Only a corner portion of the bed frame or stretcher frame is shown, since the details of the remainder of the structure of the bed or stretcher are not important to an understanding of the invention. The portion which is shown, however, includes an end frame member 50 joined at a corner to a side frame member 51. At this corner, a flat mounting bracket 53 may be bolted or otherwise attached to the corner, as shown most clearly in FIGS. 6 and 8. The bracket 53 extends a short distance beyond the side frame member 51 and is parallel to the end frame member 50. The end of the bracket has a downwardly extending short hollow tube 55 attached to it. This tube 55 is comparable in function to the tube 21 of the embodiment shown in FIGS. 1 to 5.

As shown most clearly in FIG. 7, an elongated axial slot 56 is cut through the wall of the tube 55 a short distance downward from its open upper end. The slot 56 terminates in a bottom portion 57. Spaced slightly above the bottom portion 57 is a circumferential slot 58 which extends substantially 90° around the circumference of the tube 55 and terminates in a downward axial slot 59. The width of the slots 56, 57, 58, and 59 is selected to accomodate a pin 60 which extends radially outwardly from a tube 61, sized to permit axial and rotational movement of the tube 61 in the tube 55. The manner in which the two parts are assembled together is indicated in FIG. 6. The slots 56-59 in the tube 55 define and limit the movement of the tube 61 in the hollow tube 55 by cooperating with the pin 60 in the same manner as the pin 27 on the tube 26 of the embodiment shown in FIGS. 1 to 5 functions.

The upper end of the tube 61 has a right angle extension arm 64 attached to it and the extension arm 64, in turn, is attached to the bracket 37 near its upper end by means of a pin 65 in the same manner as the pin 46 attaches the extension 35 to the bracket 37 of the embodiment shown in FIGS. 1 to 5, and described above.

The stored position of the bracket 37 of the embodiment shown in FIGS. 6–9 is illustrated in solid lines in FIG. 8. In this position, the pin 60 rests in the bottom of the slot 59 in the tube 55 so that the arm 64 and bracket 37 lie in a plane which is parallel to the side frame member 51 of the bed or stretcher.

To move the bracket to its use position, the rod 61 is pulled upwardly to align the pin 60 with the top of the slot 58 and then is rotated counterclockwise (in FIG. 8) to cause the pin 60 to engage the side wall of the vertical slot 57. When this occurs, the rod 61 then is allowed to drop downwardly, so that the pin 60 rests in the slot 57 at the lower end of the slot 56. This position "use" is shown in dotted lines in FIG. 8. The I V stand pole 14 then is clamped in the clamp between the V-shaped supports 38 and 39 by the action of the thumbscrew 41 bearing against the opposite side of the pole 14 in the manner described previously in conjunction with the embodiment shown in FIGS. 1–5. This is illustrated in FIG. 9.

FIG. 9 also illustrates, in dotted lines, some alternative positions of thumbscrew holding brackets comparable to the bracket 40 and 41. When these alternative positions are used, the bracket 40 and the thumbscrew 41 shown in solid lines in FIG. 9 is eliminated. In the alternative positions, one leg of each of the V-shaped support members 38 and 39 is extended to a shape of the type used for the member 40. Thumbscrews then are provided for both of these locations and grip the rod 14 at two points directly opposite the V-shaped support members 38 and 39. The manner of use of the device, however, is exactly the same as described previously in conjunction with both embodiments shown in solid lines in the drawings.

Various other changes and modifications will occur to those skilled in the art without departing from the scope of the invention. For example, the hollow tube and slot/pin arrangement of the interconnecting parts of the coupling may be reversed. That is, the rods 26 and 61 may be made in the form of hollow tubes which fit over the members 21 and 55 of the two embodiments disclosed. Suitable movement limiting stops in the forms of slots and pins still may be provided in such an arrangement. In addition, different forms of clamps or brackets for attachment to the I V stand pole 14 may be utilized.

I claim:

1. A coupling for interconnecting a wheeled intravenous feeding bottle support stand with a wheeled patient-carrying apparatus including in combination:

a first tubular member for rigid attachment to a wheeled patient-carrying apparatus;

a second tubular member having clamp means attached to one end thereof, said clamp means being adapted for removable attachment to the pole of a wheeled intravenous feeding bottle support stand;

means for interconnecting said first and second members for axial rotation relative to one another; and means responsive to a first relative rotational position of said first and second members with respect to one another for holding and maintaining said second member adjacent the patient-carrying apparatus in a first stored position relative to said first member and responsive to a second relative rotational position of said first and second members with respect to one another for holding and maintaining said second member in a second use position spaced at least in part away from said patient-carrying apparatus.

2. The combination according to claim 1 wherein said first and second members are tubular members, at least one of which is hollow with the other of said members inserted into such hollow member for effecting said relative rotational positions of said members.

3. The combination according to claim 2 wherein said first tubular member is hollow.

4. A coupling for interconnecting a wheel intravenous feeding bottle support stand with a wheeled patient-carrying apparatus including in combination:

a first hollow tubular member for rigid attachment to a wheeled patient-carrying apparatus, said first tubular member having an axial slot formed through the wall of said first member for a portion of the length thereof, with at least one offset circumferential slot joining said axial slot; and a second tubular member having clamp means attached to one end thereof, said clamp means being adapted for removable attachment to the pole of a wheeled intravenous feeding bottle support stand, said second tubular member being inserted into said first tubular member and said second tubular member having a radially extending slot engagement pin thereon for extending into the slot in said first tubular member when said second tubular member is inserted into said first tubular member;

wherein said pin on said second tubular member engages said slot in said first tubular member for controlling and limiting the axial and rotational movement of said second tubular member within said first tubular member to define a first stored position of said second member adjacent the patient-carrying apparatus and for defining a second use position of said second tubular member spaced at least in part away from said patient-carrying apparatus for connection of said clamp means with the pole of such wheeled intravenous feeding bottle support stand so that such stand is coupled for movement with such wheeled patient-carrying apparatus.

5. The combination according to claim 4 wherein said second tubular member is adapted for telescoping movement within said first tubular member defined by the limits by said axial slot.

6. The combination according to claim 5 wherein said clamp means attached to said one end of said second tubular member comprises a clamp member carried on an extension rod attached to said one end of said second tubular member at a 90° angle thereto.

7. The combination according to claim 6 wherein the wheeled patient-carrying apparatus is a wheelchair and said axial slot through the wall of said first tubular member is intermediate the ends thereof and is in a substantially horizontal plane with said first tubular member attached to the wheelchair, with a first circumferential slot extending downwardly from said axial slot at the extreme end thereof located toward the front of the wheelchair when said first tubular member is attached thereto and including at least a second circumferential slot opening into said axial slot and extending substantially 90° from said axial slot over the top of said first tubular member when said first member is attached to said wheelchair, said first circumferential slot defining said stored position of said members and said second circumferential slot defining said use position of said members.

8. A coupling for interconnecting a wheel intravenous feeding bottle support stand with a wheeled bed including in combination:

a first hollow tubular member for rigid attachment in a vertical orientation to said wheeled bed, said first hollow tubular member having a circumferential slot extending at least 90° along the circumference of said first hollow tubular member; a second tubular member inserted into said first tubular member for relative telescoping movement therewith and for axial rotation relative to said first tubular member, said second tubular member having a radially extending slot engagement pin thereon for extending into said slot in said first tubular member when said second tubular member is inserted into said first tubular member;

wherein said pin and said slot limit the relative rotational movement of said first and second tubular members for holding said second member in a first stored position relative to said first member and for holding said second member in a second use position for connection of said clamp means with the pole of such wheeled intravenous feeding bottle support stand so that such stand is coupled for movement with such wheeled bed, said stored and said use positions comprising different relative rotational positions of said first and second tubular members with respect to one another.

9. The combination according to claim 8 wherein said clamp means attached to said one end of said second tubular member comprises a clamp member carried on an extension rod attached to said one end of said second tubular member at a 90° angle thereto.

* * * * *